United States Patent [19]

Wojdyla

[11] Patent Number: 5,000,376

[45] Date of Patent: Mar. 19, 1991

[54] VOID FILLER APPARATUS

[75] Inventor: Philip J. Wojdyla, Aurora, Colo.

[73] Assignee: Stone Container Corporation, Chicago, Ill.

[21] Appl. No.: 551,183

[22] Filed: Jul. 11, 1990

[51] Int. Cl.[5] ..... B65D 5/48

[52] U.S. Cl. ..... 229/120.11; 229/120.14; 229/120.15

[58] Field of Search ..... 229/120.14, 120.11, 229/120.15, 104, 120.16, 120.17, 120.18

[56] References Cited

U.S. PATENT DOCUMENTS 3,433,401 3/1969 Swift ..... 229/120.11
4,186,846 2/1980 Jacalong et al. ..... 229/120.11
4,903,892 2/1990 McNair et al. ..... 229/120.11
4,913,291 4/1990 Schuster ..... 229/120.11

*Primary Examiner*—Joseph Man-Fu Moy
*Attorney, Agent, or Firm*—Dick and Harris

[57] ABSTRACT

A void filler apparatus for separating and spacing articles towards preventing cargo from shifting during shipment. A series of wall members formed from a single sheet of material articulate into tubular sleeves which are maintained in position by locking flap members. Wing members are formed along the tubular sleeve to facilitate maintenance of the apparatus between adjacent cargo articles. The apparatus is collapsible upon itself for facilitate shipment while minimizing material requirements for formation.

17 Claims, 3 Drawing Sheets

VOID FILLER APPARATUS

BACKGROUND OF THE INVENTION

The present invention relates in general to dunnage or shipping accessory containers for maintaining packaged articles in a confined position during shipment and in particular, to a void filler apparatus for occupying a position among various cargo containers, while keeping such articles from shifting from their designated position during transportation.

Shippers and storers of various packed articles traditionally place as many packed articles as possible within a given box car or truck trailer. In order to accomplish this objective, the shippers often occupy as much floor room as possible, while stacking the various packed articles one upon another thereafter. Even so, the packed articles often unable to fill the available box car or truck trailer space exactly—enabling the packed articles to shift position. Even where spacing is compact, lightweight or collapsible containers may adjoin heavier bulky containers which, during shipment, could still present danger of breakage as a result of sudden movement or shifting—especially where fragile materials are involved.

For many years various devices have been used by shippers to fill up the spaces between packed articles so that the articles will not move or shift from their prepositioned placement during vehicle movement. A common device for this purpose has been dunnage bags which have been placed between packed articles to fill up these empty spaces. These have traditionally been filled with various forms of shock absorbing materials such as peanut-shaped polystyrene materials and/or various kinds of bubble packing. Air tight constructions have been used for inflatable dunnage bags—towards shock absorption and shift prevention. All these materials provide adequate shock absorption.

More recently a void filler apparatus has embodied a box structure of corrugated cardboard. An example of such a structure has been sold by Design Packaged Concepts of Denver, Colo. This box-like structure utilizes two separate rectangular sleeves of corrugated material, each making an enclosed rectangular tube, both tubes of which are joined together by adhesive along one side at a 2-ply region. The prior art apparatus does not form completed independently formed and sealed rectangles, but rather applies adhesive to the overlapping portions of the two separate rectangular sleeves, thereby forming and affixing tubes to one-another to, in turn, construct that void filler apparatus. This prior art construction also contains deployable flap members to maintain the shape of these sleeves. However, these members do not contain any type of positive locking means. Once deployed, the rigidity flap members are held in place with a friction interference fit. As part of this prior art configuration, an additional piece of corrugated material is adhesively attached to the back of one of the rectangular sleeves as a "wing", in order to further secure the placement of the void filler relative to the adjacent packed articles.

While functional, this configuration of the prior art does not utilize the advantages that may be obtained from constructing an apparatus from a single sheet of material. Accordingly, the prior art configuration requires more corrugated material than an integrated apparatus, the use of such additional material being costlier and heavier than a void filler formed from a single sheet of corrugated material. Since the prior art configuration utilizes separate components, its overall size when collapsed is likewise substantial, when preliminarily, fully assembled. While the collapsed size would be smaller if not fully assembled, the prior art device would then require additional assembly and the use of adhesives by the user. To be utilized with various height articles, adhesive attachment of position securement wings would be required.

The prior art void filler may have the potential to collapse unexpectably during use. Since each rectangular sleeve does not have its own integrity and relies on the other sleeve to maintain structure, any problem with the adhesive attachment between the two sleeves could cause collapse of an entire sleeve portion. The device may not function properly if either sleeve collapses or is not fully deployed. Due to the lack of positive locking features on the rigidity flaps, they may likewise become undeployed during use and thereby again enhance the potential for a collapse of the device.

It is thus an object of the present invention to provide a void filler apparatus that can be utilized on various height articles during shipping or storage.

It is additionally an object of the invention to form a void filler apparatus out of a single sheet of unitary material thereby eliminating the need for as many adhesive attachments of separate components to assemble the void filler. Such a unitary sheet of material not only helps create a more stable void filler apparatus, but it also facilitates the ease of manufacturing and preliminary forming of the apparatus—at a substantially reduced cost, as a result of minimized material and associated weight requirements.

As an additional object of the invention is the continued operation of at least a portion of the present void filler invention should another portion of the void filler apparatus collapse.

These and other objects of the invention will become apparent in light of the present specification and drawings.

SUMMARY OF THE INVENTION

The present invention comprises a void filler apparatus for separating and spacing articles being utilized as a space filler so as to prevent cargo from shifting from a designated position.

In a preferred embodiment of the invention, the apparatus comprises five or more walls formed from a unitary sheet of material and successively joined to one another along their respective wall folds so as to create at least two adjacent geometrically-shaped tubular sleeves. Each of the tubular sleeve thereformed share at least one common wall as a side. The five or more wall members are fixed into their respective tubular sleeve positions by one or more attachment wall members that emanate from at least one of the five or more walls.

Also emanating from at least one of the five walls, is one or more locking flap members. The locking flap members are capable of being deployed to be restrainably affixed proximate to an adjacent wall—to help restrain and reinforce the integrity of at least one of the two or more tubular sleeves.

The apparatus also comprises position retention wings which emanate from at least one of the wall members. These position retention wings are positioned behind articles adjacent to the void filler to keep the articles in their proper place. The position retention wings include at least a first wing portion and a second wing portion wherein the first wing portion and second wing portion emanate from the tubular sleeve wall, in opposite directions.

In this preferred embodiment of the invention, the apparatus comprises a six wall construction in which these walls articulate to form two or more tubular chambers, with each chamber sharing at least one common wall between them. The chambers also are enclosed by at least one wall wherein a first portion of the wall encloses one tubular chamber, while the second portion of the same wall encloses the other tubular chamber. In this embodiment, the tubular chambers formed by the six walls are substantially rectangular in shape.

Also in the preferred embodiment of the invention, the tubular chambers include upper and lower locking flap members. These locking flap members are positioned inwardly from the upper and lower ends of the void filler apparatus within the wall from which they emanate. In this embodiment, these locking flap members are cut-out, and hingedly foldable away, from the respective wall of the apparatus—so as to further enable fabrication of the flap member from the same unitary sheet of material forming the remaining body of the apparatus. Upon deployment, the locking flap members insure the rigidity and integrity of the void filler apparatus, by maintaining a respective tube in its geometric shape.

Preferably, the apparatus, and particularly the locking flap members, further include locking means located on the respective locking flap member, for maintaining the locking flap member in the deployed position, affixed relative to the wall to which the flap member becomes adjacent. This locking means can be embodied by an interference, friction fit between the edge of the locking flap member and the aligned surface of the adjacent wall. Alternatively, the locking means may embody a tab structure located at the edge of the locking flap member that operably engages an aligned aperture located on the wall that becomes adjacent to the flap member upon deployment.

In the preferred embodiment, the upper and lower locking flap members are scored upon their hinged fold to facilitate folding and deployment of the locking flap into position relative to the adjacent wall. In this preferred embodiment, the attachment wall means comprises two attachment wall members. The first of the attachment wall members emanates from the common wall shared by the tubular chambers. This attachment wall member folds away from the common wall, onto an adjacent wall and is attached to the adjacent wall by an adhesive. The second attachment wall member is non-foldable and is overlapped upon an adjacent, substantially co-planar wall member to complete the articulated formation of the void filler apparatus. Likewise, this second attachment wall member is adhered to the adjacent co-planar wall by adhesive.

While emanating from at least one of the geometric tubular sleeve walls, the first wing portion and second wing portion of the position retention wing means may be located on virtually any wall. The two wing portions may be positioned at substantially the same height or may be located at substantially different heights so that the void filler apparatus may be utilized with different height articles while facilitating their integrated fabrication out of the overall apparatus blank. While a separate wing member may be utilized and adhered to the tubular sleeve so as to comprise the position retention wing, another preferred embodiment contemplates formation of the position retention wing from the same unitary sheet of material as the void filler apparatus—thereby eliminating separate affixation of the wing member to the wall member.

The apparatus may be formed from many different types of material. Two such contemplated materials are paperboard and corrugated cardboard, for formation of the single unitary sheet. These materials facilitate the capability of the apparatus to collapse upon itself, thereby substantially reducing the amount of space occupied by the void filler to facilitate the ease of shipping and storing of the apparatus when the apparatus is not being utilized in its deployed position.

In yet another preferred embodiment, the void filler apparatus comprises three or more walls formed from a unitary single sheet of material successively folded upon their edges. These walls are likewise folded upon at its successive edges to form a substantially tubular sleeve member, which walls are kept in their geometrically tubular sleeve formation by one or more attachment walls emanating from at least one of the three wall members. Reinforcing the shape and integrity of the tubular sleeve are one or more locking flap members that emanate from at least one of the walls, so as to be affixed to at least one of the adjacent walls.

In this preferred embodiment, the position retention wings comprise a first wing portion and a second wing portion that are at substantially different heights, in order to stabilize the positions of various height articles and maintain their respective designated positions.

DETAILED DESCRIPTION OF THE DRAWINGS

Figure 1:
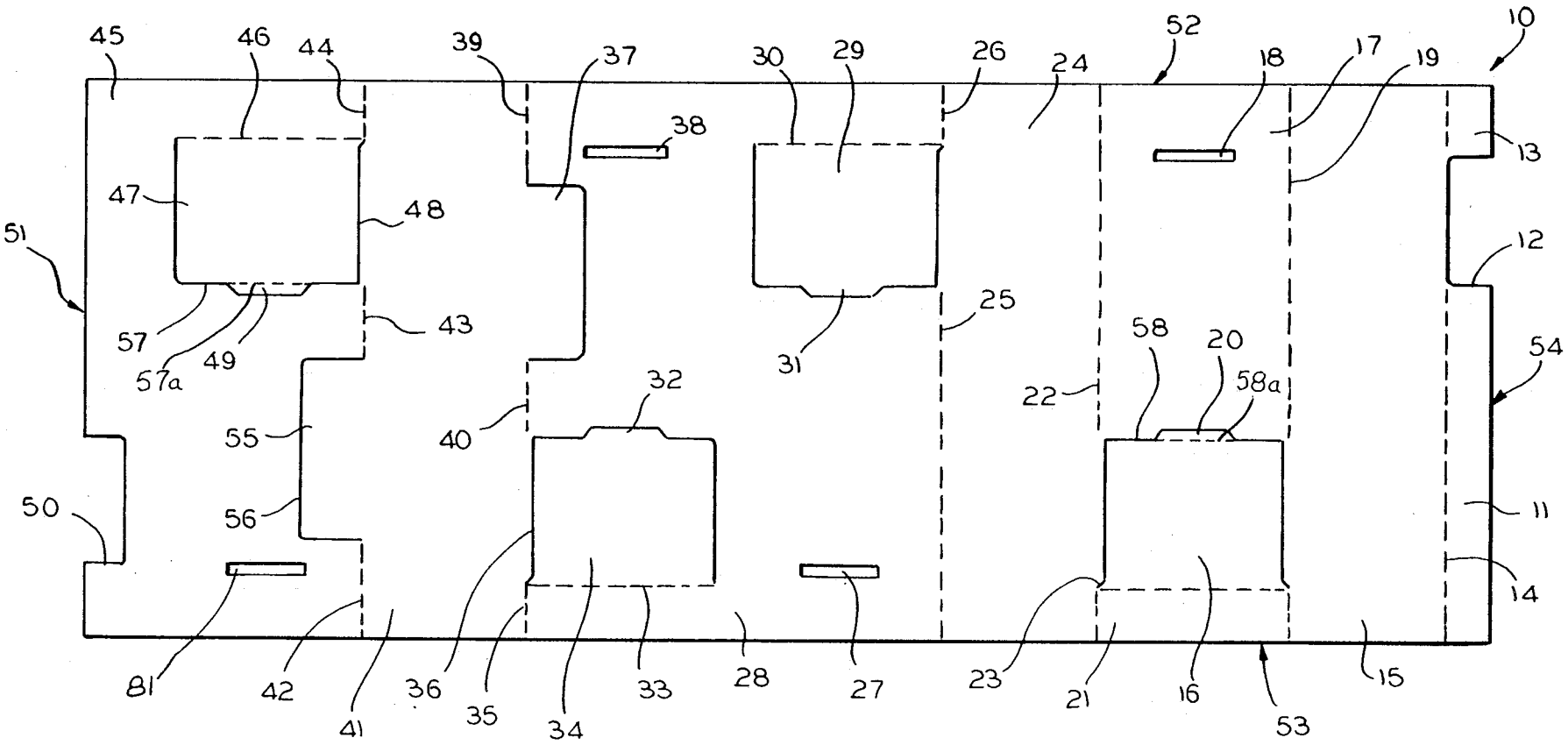
FIG. 1 of the drawings is an elevated side, view of the non-articulated apparatus blank, comprising a single unitary sheet of board or corrugated material, prior to articulation into the geometrically shaped tubular sleeve members.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Void filler apparatus 10 is shown in FIG. 1 as comprising longitudinally displaced wall members 15, 17, 24, 28, 41 and 45; Also shown are respective wall folds 19, 22, 25-26, 35-39-40, and 42-43-44; upon which the longitudinally displaced wall members are folded to form the geometric tubular sleeves.

Emanating from longitudinally displaced wall member 15 is foldable attachment wall means 54 for adhesive affixation, upon articulation, to an adjacent wall member. Locking flap members 16, 29, 34 and 47 are shown containing respective tab portions 20, 31, 32, and 49 for engaging respective apertures 27, 18, 81 and 38, so as to effectively lock the locking flap members adjacent the wall members bearing the locking apertures. Alternative flat, non-tabbed edge configuration 57*a* of locking flap member 47 would engage by interference fit, an adjacent wall member upon full deployment—without requiring any tab apertures.

Also shown in FIG. 1 is scoring 23, 30, 33 and 46 of locking flap members 16, 29, 34 and 47, respectively, to facilitate the ease with which the locking flap members will fold. Locking flap members 16, 29, 34 and 47 are positioned inwardly displaced from the top and bottom edges of their respective longitudinally displaced wall members 17, 28 and 45. Position retention wing means 37 and 55 are cut-out of and emanating from one of the longitudinally displaced wall members, namely wall member 41. In this embodiment, the position retention wings 37 and 55 are at substantially different heights. Attachment wall means 54 emanates from longitudinally displaced wall member 15 while non-foldable attachment wall means portion 51 emanates from wall 45 for overlying affixation over adjacent wall 17 (FIG. 2) upon articulation. When fully deployed, attachment portion 51 of longitudinally displaced wall member 45 will overlap displaced wall member 17.

Figure 2:
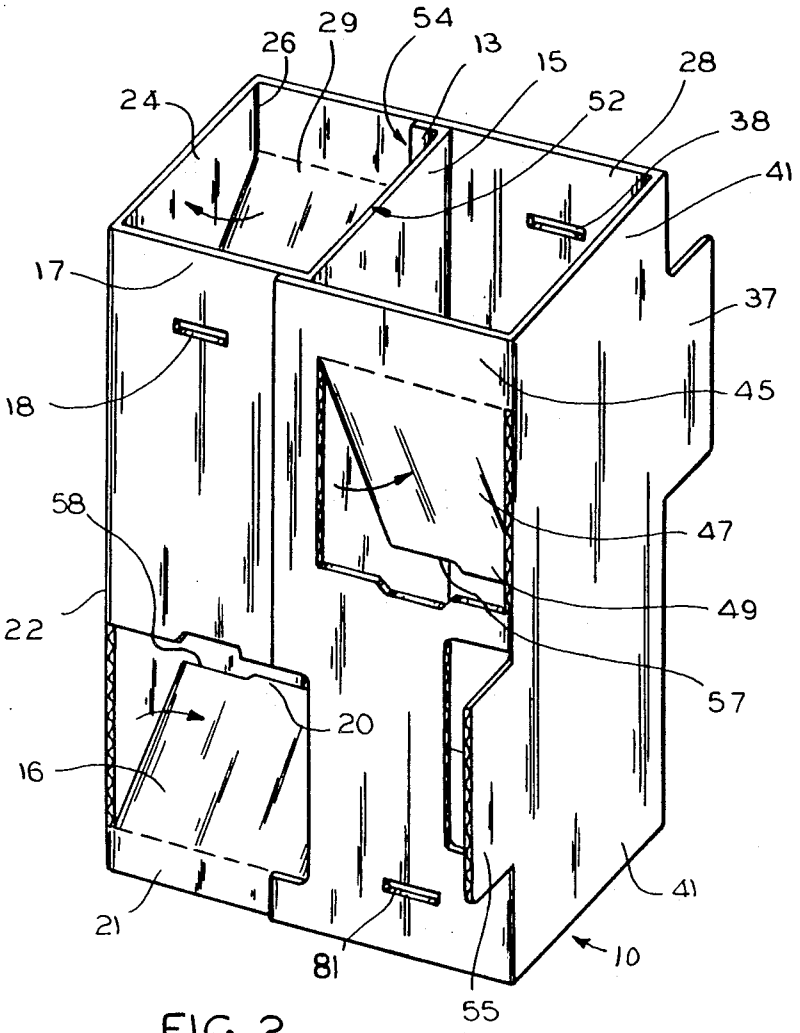
FIG. 2 of the drawings is a top-side perspective view of the articulated apparatus showing two formed tubular sleeves forming two respective chambers with locking flap members being deployed therewithin.

In FIG. 2, the void filler apparatus of FIG. 1 is shown in an articulated fashion so as to form the geometrically shaped substantially tubular sleeve members. Particularly shown are the six longitudinally displaced wall members 15, 17, 24, 28, 41 and 45 folded upon fold lines 19, 22, 25-26, 35-39-40, 42-43-44 of FIG. 1 to form two tubular chambers. Emanating from common wall member 15 is attachment wall means 11–13 of FIG. 1 having outside edge 54, which is folded upon fold line 14 on to adjacent longitudinally displaced wall member 28 and adhesively attached thereto. Locking flap members 16, 29 and 47 are shown inwardly displaced from the top and bottom edge of respective longitudinally displaced wall members 17, 28, and 45. Locking flap members 16 and 47, containing tab portions 20 and 49, are inwardly folded, in the direction of the arrows, towards the respective opposite longitudinally displaced wall member 28 so as to engage the apertures 27 and 38 on that opposite wall member by not only a friction fit, but also by positive locking between locking tabbed flap member 47 and 16 and adjacent longitudinally displaced wall member 28. Tab portions 20 and 49 may be eliminated from locking flap members 16 and 47 so as to operate locking means by way of a interference friction fit between alternative locking flap member edges 57*a* and 58*a* and longitudinally displaced wall member 28. First wing portion 37 and the second wing portion 55 of the position retention wing means emanate from a longitudinally displaced wall member 41 in substantially opposite directions, and are located at substantially different heights on longitudinally displaced wall member 41 to accommodate varying heights of adjacent articles.

Figure 3:
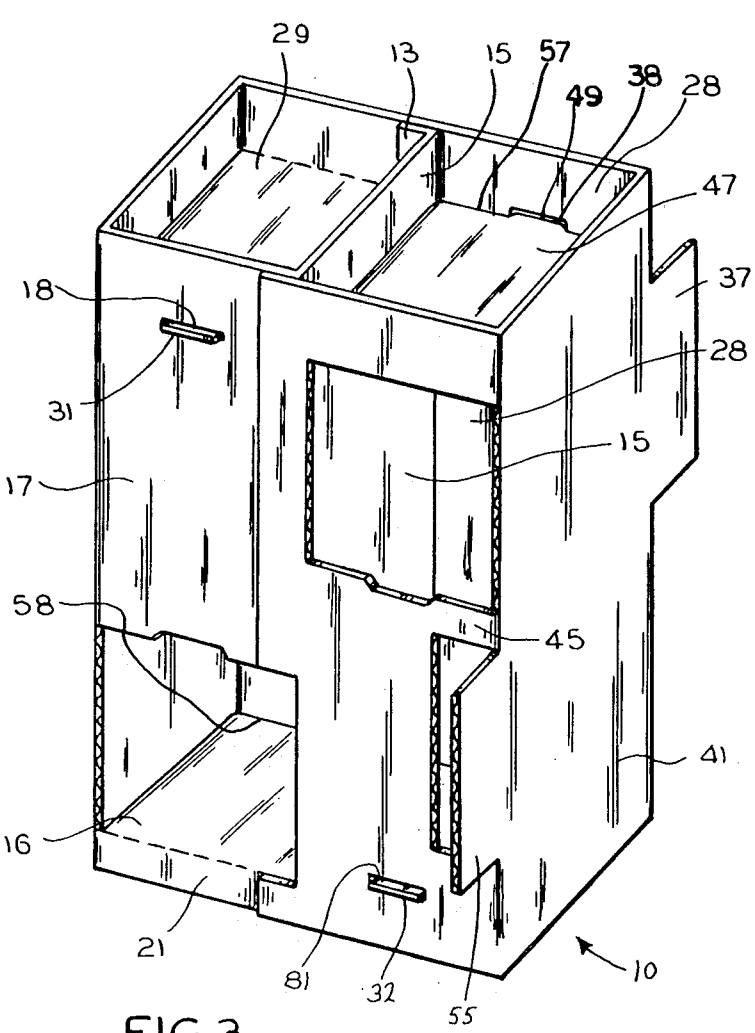
FIG. 3 is a top-side perspective view of the geometric tubular sleeve construction of FIG. 2, in which the locking flap members have been fully deployed.

In FIG. 3, as in FIG. 2, void filler apparatus 10 is fully articulated and deployed forming a geometrical, substantially tubular sleeve member comprising two tubular chambers sharing common wall 15. First wing portion 37 and second wing portion 55 of the position retention wing means emanate from longitudinally displaced wall member 41 in different directions at substantially different heights. Locking flap members 16, 29 and 47 are fully deployed in the locked position having tab portions 31, 32, 49 operably engaging and protruding through apertures 18, 81, and 38 of adjacent longitudinally displaced wall members 17, 45 and 28, so as to be suitable for complete functionality.

Figure 4:
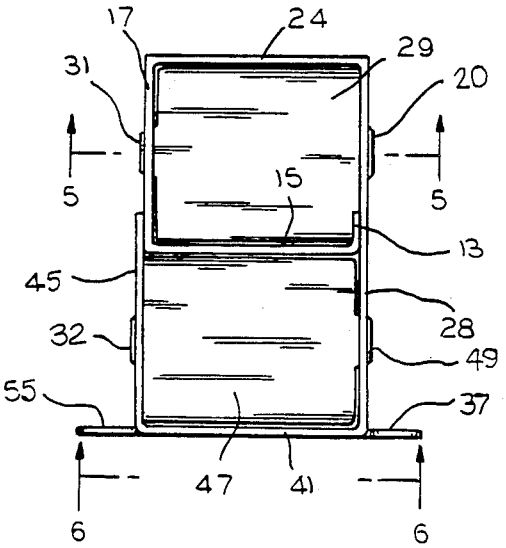
FIG. 4 is a top plan view of the present void filler apparatus showing its articulated geometric tubular sleeves forming two chambers, with its upper and lower locking flap members fully deployed.

FIG. 4 is a top plan view of the fully deployed articulated geometrically shaped, substantially tubular, sleeve member shown in FIG. 3. Locking flap members 16, 29, 31 and 47 are in their locked positions wherein tab portions 20, 31, 32 and 49 operably engage and protrude through apertures 27, 18, 81 and 38 on adjacent longitudinally displaced wall members 28, 17, 45. Additionally, longitudinally displaced wall member 15 divides void filler apparatus into two tubular chambers, by adjoining wall member 15 to the adjacent longitudinally displaced wall member 28 by means of folded attachment wall means 13. First wing portion 37 and second wing portion 55 of position retention wing means emanate from longitudinally displaced wall member 41 at different heights though in another embodiment wing retention means 37 and 55 may be at substantially the same height.

Figure 5:
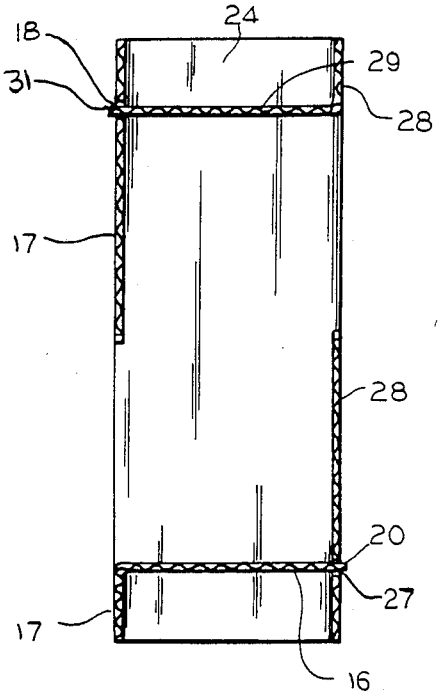
FIG. 5 is a cross-sectional elevated side, view taken along lines 5—5 of FIG. 4 and looking in the direction of the arrows, showing the void filler apparatus as configured in FIG. 4 with its locking flap members being fully deployed.

In FIG. 5, locking flap members 16 and 29 are shown fully deployed in their locked positions, with tab portions 20 and 31 of locking flap members 16 and 29 engaging apertures 27 and 18 and protruding past adjacent longitudinally displaced wall members 28 and 17. When properly deployed locking flap members 16 and 29 remain substantially perpendicular to longitudinally displaced wall members 17 and 28.

Figure 6:
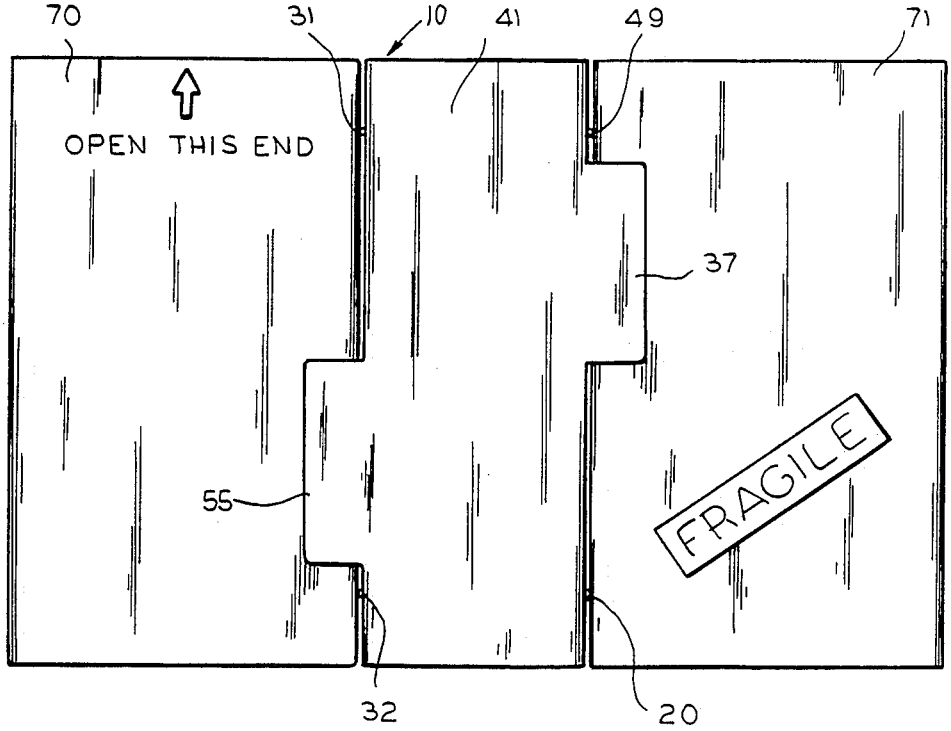
FIG. 6 is an elevated side view of the apparatus taken along lines 6—6 of FIG. 4 and looking in the direction of the arrows, showing the apparatus positioned between two packaged articles with its the retention wing member portions deployed at different heights.

FIG. 6 shows void filler apparatus 10 being fully articulated, deployed and utilized between two adjacent cargo articles 70 and 71. Tab portions 20, 31, 32 and 49 of locking flap members 16, 29, 34 and 47 can be seen to extend past the longitudinally displaced wall members 28, 17 and 45 of void filler apparatus 10 through penetration of their aligned locking apertures. Additionally, first wing portion 37 and second wing portion 55 emanate in opposite directions from each other while being located at substantially different heights upon longitudinally displaced wall member 41. Position retention wing means 37 and 55 are positioned adjacent to and behind the cargo articles 70 and 71 in order to retain the proper location of void filler apparatus 10 and articles 70 and 71 during shipment and/or storage.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A void filler apparatus for separating and spacing articles, said apparatus being utilizable as a space filler so as to prevent cargo from shifting from a designated and/or desired position, said apparatus comprising:

five or more longitudinally displaced wall members successively joined to one another along respective wall fold edges, one or more attachment wall means longitudinally displaced and operably emanating from at least one of said five or more wall members, said five or more wall members articulated and foldable along said successive wall fold edges so as to be formable into at least two adjacent geometrically shaped tubular sleeve members, each of which tubular sleeve members share at least one common wall member as a common side therebetween said one or more attachment wall means operably and restrainably affixing said five or more wall members into said at least two tubular sleeve members, one or more locking flap members emanating from at least one of said wall members for restrained affixation in a deployed position adjacent to at least one of said remaining wall members, to reinforce the shape and integrity of at least one of said two or more geometrical shaped substantially tubular sleeve members, position retention wing means operably emanating from at least one of said wall members at a side thereof, for positioning behind respectively adjacent surfaces of articles positioned on either side of said void filler apparatus towards maintenance of said void filler apparatus therebetween said respective spaced articles, said position retention wing means comprising at least a first wing portion emanating from at least one of said tubular sleeve wall members and a second wing portion emanating from at least one of said tubular sleeve wall members, said first wing portion emanating in a substantially opposite direction to said second wing portion, said five or more longitudinally displaced wall members forming said two or more geometrically shaped tubular sleeve members, being formed out of a single unitary sheet of apparatus material.

2. The invention according to claim 1 wherein said five or more longitudinally displaced wall members comprises six longitudinally displaced wall members, said two or more tubular sleeve members comprising two tubular chambers, each of which chambers sharing a common wall member therebetween, each of said chambers further being formed by a portion of a second wall member are part of which forms the first of said two chambers and the other part of which second wall forms the second of said two chambers, each of said two chambers being substantially rectangular in shape.

3. The invention according to claim 2 wherein each of said two tubular chambers includes an upper and lower locking flap members emanating between said longitudinally displaced wall members, each of said upper and lower locking flap members being inwardly spaced from the upper and lower ends of the void filler apparatus respectively, and each of said upper and lower locking flap members emanating from a first wall member for operable restraint adjacent a second wall member opposite said first wall member.

4. The invention according to claim 3 wherein each of said upper and lower locking flap members are cut from and hingedly folded so as to emanate from said longitudinally displaced wall member, and thus from said same unitary sheet of apparatus material.

5. The invention according to claim 1 wherein each of said one or more locking flap members emanating between respective ones of said longitudinally displaced wall members includes, locking means for maintaining said locking flap member in their deployed position relative to said adjacent wall member, said locking means comprising an interference fit between said locking flap member and said adjacent wall member.

6. The invention according to claim 1 wherein each of said one or more locking flap members emanating between respective ones of said longitudinally displaced wall members includes, locking means for maintaining said locking flap member in their deployed position relative to said adjacent wall member, said locking means comprising at least one tab located on said locking flap member and an aperture located on at least one of said wall members so that said tab operately engages said aperture of said adjacent wall member.

7. The invention according to claim 4 wherein each of said upper and lower locking flap members emanating from said one or more longitudinally displaced wall members is further scored along the its respective hinged fold in order to facilitate the foldability of said locking flap member.

8. The invention according to claim 2 wherein said one or more attachment wall means comprises two attachment wall means, a first of said two attachment wall means emanating from said common wall for folded and adhesive attachment to an adjacent wall member, a second of said two attachment wall means being non-foldable and adhesively attached to overlie a substantially co-planar adjacent wall member.

9. The invention according to claim 1 wherein said first wing portion and said second wing portion of position retention wing means emanate from at least one of said geometric tubular sleeve wall members, at substantially the same height.

10. The invention according to claim 1 wherein said first wing portion and said second wing portion of said retention wing means comprise a separate wing member operably attached to said longitudinally displaced wall member by an adhesive substance.

11. The invention according to claim 1 wherein said first wing portion and said second wing portion of said retention wing means comprises a wing member cut from and emanating from said at least one tubular sleeve wall members and thus from said same unitary sheet of apparatus material.

12. The invention according to claim 1 wherein said first wing portion and said second wing portion of position retention wing means emanate from at least one of said geometric tubular sleeve wall members, at substantially different heights.

13. The invention according to claim 1 wherein said single unitary sheet of apparatus material comprises a paper board material.

14. The invention according to claim 1 wherein said single unitary sheet of apparatus material comprises a corrugated cardboard.

15. The invention according to claim 1 wherein said void filler apparatus, as articulated into its said tubular sleeve members, and prior to deployment of said locking flap members is collapsible upon itself so as to substantially reduce the amount of space occupied by said void filler thereby facilitating the easy of shipping and storing of said apparatus.

16. A void filler apparatus for separating and spacing articles, said apparatus being utilizable as a space filler so as to prevent cargo from shifting from a designated and/or desired position, said apparatus comprising:

three or more longitudinally displaced wall members successively joined to one another along respective wall fold edges, one or more attachment wall means longitudinally displaced and operably emanating from one of said three or more wall members, said three or more wall members articulated and foldable along said successive wall fold edges so as to be formable into a geometrically shaped substantially tubular sleeve member, said one or more attachment wall means operably and restrainably affixing said three or more wall members into said substantially tubular sleeve member, one or more locking flap members emanating from at least one of said wall members for restrained affixation adjacent to at least one of said remaining wall members to reinforce the shape and integrity of said geometric shaped substantially tubular sleeve member, position retention wing means operably attached to at least one of said wall members at a side thereof, for positioning behind respectively adjacent surfaces of articles positioned on either side of said void filler apparatus towards maintenance of said void filler apparatus therebetween said respective spaced articles, said position retention wing means comprising at least a first wing portion emanating from the side of at least one of said tubular sleeve wall members at a first height along said wall member and a second wing portion emanating from the side of at least one of said tubular sleeve wall members at a second height along said wall member said first height being substantially different than said second height to stabilize the positions of various height articles, said three or more longitudinally displaced wall members forming said geometric tubular sleeve member being formed out of a single unitary sheet of apparatus material.

17. The invention according to claim 16 in which said first wing and second wing portions emanate in opposite directions from the same tubular sleeve wall member.

* * * * *